US005638701A

United States Patent [19]

Dempsey

[11] Patent Number: 5,638,701

[45] Date of Patent: Jun. 17, 1997

[54] ADHESIVELY FASTENED PROTECTOR FOR EARLOBE

[76] Inventor: Karen E. Dempsey, E. 3312 Moody Rd., Mead, Wash. 99021

[21] Appl. No.: 633,008

[22] Filed: Apr. 16, 1996

Related U.S. Application Data

[63] Continuation of Ser. No. 685,055, Apr. 15, 1991, abandoned.

[51] Int. Cl.[6] ..... A44C 7/00

[52] U.S. Cl. ..... 63/12; 63/DIG. 1

[58] Field of Search ..... 63/2, 12, 14.2, 63/14.3, DIG. 1

[56] References Cited

U.S. PATENT DOCUMENTS

| | | | |
|---|---|---|---|
| 119,530 | 10/1871 | Northrup . | |
| 1,971,216 | 8/1934 | Gould | 63/DIG. 1 X |
| 2,763,999 | 9/1956 | Norman . | |
| 4,067,341 | 1/1978 | Ivey . | |
| 4,139,993 | 2/1979 | Tucker . | |
| 4,195,492 | 4/1980 | Johnson . | |
| 4,630,452 | 12/1986 | Connelly et al. | 63/12 |
| 4,771,613 | 9/1988 | Gizier et al. | 63/12 |
| 4,774,817 | 10/1988 | Beam et al. . | |
| 4,974,430 | 12/1990 | Turner | 63/12 |

*Primary Examiner*—Kenneth J. Dorner
*Assistant Examiner*—Jerry Redman

[57] ABSTRACT

A small patch of flexible sheet material defines in its medial portion a hole to receive a fastening post of an earring to be carried, by a human earlobe. One surface of the patch is coated with adhesive material to adhere the patch to an earlobe. The adhesive coated surface may be provided with a protective cover for removal prior to patch use. The patch is positionable on one or both sides of a human earlobe with the hole defined in the patch coincident with an earring post hole defined in that earlobe, to reinforce the earlobe tissue about the earring post hole.

10 Claims, 1 Drawing Sheet

ADHESIVELY FASTENED PROTECTOR FOR EARLOBE

This application is a continuation of application Ser. No. 07/685,055, filed Apr. 15, 1991, now abandoned.

BACKGROUND OF INVENTION

RELATED APPLICATIONS

There are no applications relates hereto heretofore filed in this or any foreign country.

FIELD OF INVENTION

My invention relates generally to a prosthesis for the external ear, and more particularly to a flexible reinforcing patch to protect earlobe tissue about a hole defined therein to support an earring fastening post.

BACKGROUND AND DESCRIPTION OF PRIOR ART

Ear ornaments of various sorts have been used by humans since times immemorial. One method of support of such ornaments has been in small boles created, generally by a piercing processes, in the ear structure itself to define holes extending therethrough. These pierced holes are commonly formed in an ear structure by forcing a needle-like device through that tissue and thereafter maintaining a small rod or needle in the hole until the tissue defining it has healed and regenerated its surface surrounding the hole so as to maintain the defined channel. Commonly such holes in a non-stressed condition are of a diameter less than approximately one millimeter and though usually they are created in the lobule, they are not unknown in the helix, the antihelix or the fossa of either.

The external structure of the human ear is a fairly delicate fleshy cartilaginous structure, and the lobule is especially delicately formed, largely from dermal and fatty tissue. This tissue readily allows the formation of holes by piercing operations, but does not provide any great or substantial physical support for rods or wires of ear ornaments carried in such boles. Historically in western culture at least, pierced ear holes have been relatively small and the objects that have been supported in them have also been relatively small to alleviate any particular support problems, since forces created between a supported ornament and an earlobe have been relatively small. Those forces, however, are distributed over only relatively small areas to create a potentiality of stretching, tearing or similar damage to the earlobe tissue.

Problems associated with support of ear ornaments in holes defined in the external ear structure have existed as long as such ornaments have been known, as the application of any external forces on such ear ornaments normally is not well accommodated by the external ear structure. In the recent past, the support problem has been accentuated by the use of increasingly larger and more massive ear ornament structures. The aesthetic and social desirability of earrings and similar ear ornaments has tended toward these relatively large structures, and the structures in turn necessarily provide relatively larger masses that substantially increase both static and dynamic forces on the tissue defining holes in an ear structure supporting the ornaments. These forces cause a continuous and progressive stretching in a downward direction of the tissue about an ear hole by reason of gravity acting on an ear ornament and may cause tissue damage in other directions by reason of directly applied external forces or inertia. Sometimes such forces are sufficient to cause tearing, but most commonly gravity forces cause gradual elongation of an earlobe hole in a downward direction. Either or both of these actions tend to exasperate the problem of hole enlargement in the future from similar causes.

Enlargement of pierced ear holes often is severe enough that a channel is defined from the original pierced hole to and through the periphery of the adjacent ear structure to make a hole relatively useless and often to cause pain, bleeding, infection or other disabilities. In the modern day, the surgical repair of earlobes having enlarged or torn earring holes has become a substantial element of the practice of cosmetic plastic surgery.

These problems have heretofore been recognized and various solutions have been proposed to remedy them. My invention provides a new and novel device to solve the problems in their inception and also to aid rehabilitation of damaged ear holes.

Most solutions that have been proposed in the past to prevent enlargement of earring holes have involved a rigid support device to distribute forces created between an ear ornament and the surrounding supporting ear tissue over a larger area. These structures have devolved along two principal lines. The first line provides two enlarged rigid disk elements to extend over tissue surrounding an earring support hole on both sides of the ear structure, with some mechanical means for creating force between the two disks so that an ear ornament rod extending through holes defined in the opposed disks and through the ear hole therebetween is supported by the disks to distribute the force on the disks over a substantially greater area of ear tissue than would be involved by supporting the ear contacting support rod itself. This type of device is operative and accomplishes its purpose, but at the sacrifice of the benefits of supporting an ear ornament only in a pierced hole defined in the ear structure. The two opposed disks to be operative must have substantial force between them and the two sides of an ear structure and this reaction on the adjacent ear tissue is substantially no different than that of an ordinary screw-type earring. Though the lobule is not an overly sensitive portion of the human body, the forces created by such disks are often painful and irritating and if of sufficient magnitude, may tend to cause atrophy of neural sensitivity in the external ear structure. Additionally, such devices must have reasonably rigid disks to be functional, and commonly such disks have been formed of metal, which often irritates the portion of ear tissue adjacent the disk to cause pain and irritation and aid potential invasion of various microorganisms into the ear tissue surrounding an earring hole or into the earring hole itself.

The second line of proposed solutions to the distribution of forces created by an ear ornament support post over a larger area of the ear structure has been to enlarge the bearing area of the support post that is carried within a hole. This commonly has been accomplished by inserting in an earring hole a larger sleeve defining a medial channel to receive the smaller support post of an ear ornament. Such sleeves commonly have been left in place in semi-permanent fashion in a pierced ear hole after establishment therein. This solution also has its drawbacks. Such a sleeve generally does not substantially increase the effective bearing area between it and surrounding ear tissue, because sleeve size must be limited so that a sleeve will fit within an existing earring hole. If a sleeve be too large, it tends to become unsightly and defeat the aesthetic purpose of the ear ornament that is to be carried thereby and it may not be insertable in an earring hole. Additionally, since the sleeve is in direct and intimate contact with ear tissue over prolonged periods of time, the sleeve may cause irritation of ear tissue, especially by reason of allergenic reactions, and provides a habitat that tends to allow and encourage microbal growth, especially the growth of anaerobic type microbes, between adjacent surfaces of sleeve and ear tissue.

My support device solves these problems by providing an adhesively attachable patch that defines a medial hole substantially no larger than the existing hole in a pierced ear or the cross-sectional area of the post of an ear ornament to be carried therein. The support device may be used on one or both sides of an ear as desired, and is of a flexible nature so as to conform to the surface contour of the adjacent ear structure and well adhere thereto. Adhesives such as commonly used on non-allergenic adhesive tape may be used with my device to avoid allergenic problems, and the adhesive, patch, or both may be medicated to discourage microbal activity. The support patch may be used on damaged earlobes that have enlarged holes or channels communicating completely through their periphery, because the medial hole of the support device supports a post of an ear ornament and the support device will be positionally maintained by reason of its adhesion on the surface of the ear structure. The support device is particularly useful with damaged earlobes to allow healing of the tissue while still maintaining a hole for earring support to allow the use of ear ornaments during the healing process.

SUMMARY OF INVENTION

My invention generally provides a sheet-like patch of flexible material, preferably of curvilinear peripheral configuration, defining a medical hole substantially the same size as a hole defined in an ear structure to be serviced. The patch carries on one surface an adhesive coating that will adhere to both the patch and the skin of an ear structure, such as the adhesive commonly used on non-allergenic adhesive tape. The adhesive coated surface of the patch is covered by a removable cover sheet to protect the adhesive coating prior to use.

For use, at least one patch is adhered to the flesh of an ear structure, with the hole defined by the patch outwardly adjacent a hole defined in the ear structure. One such patch may be used on one side of an ear or similar patches may be used on both sides of the ear. The fastening post of an ear ornament is inserted through one or both of the holes defined in the patches and through an ear structure to aid support of the ear ornament in the hole defined in the ear structure.

In providing such an article, it is:

A principal object to provide a small aesthetically acceptable patch to aid the support of a support post of an ear ornament in a hole defined in a human ear structure.

A further object is to provide such a patch that has a flexible body defining a medial support bole with adhesive material on one side of the patch to releasably affix and positionally maintain the patch on the surface of an ear structure.

A further object is to provide such a patch that has a releasable cover on the adhesive coated surface to protect that surface prior to attachment to an ear structure.

A still further object is to provide such a patch that may be used on one or both sides of a hole defined in an ear structure.

A still further object is to provide such a patch that is of new and novel design, of rugged and durable nature, of simple and economic manufacture and otherwise well adapted to the uses and purposes for which it is intended.

Other and further objects will appear from the following specification and accompanying drawings which form a part hereof. In carrying out the objects of my invention, however, it is to remembered that its accidental features are susceptible of change in design and structural arrangement with only one preferred and practical embodiment of the best known mode of my invention being illustrated and specified, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
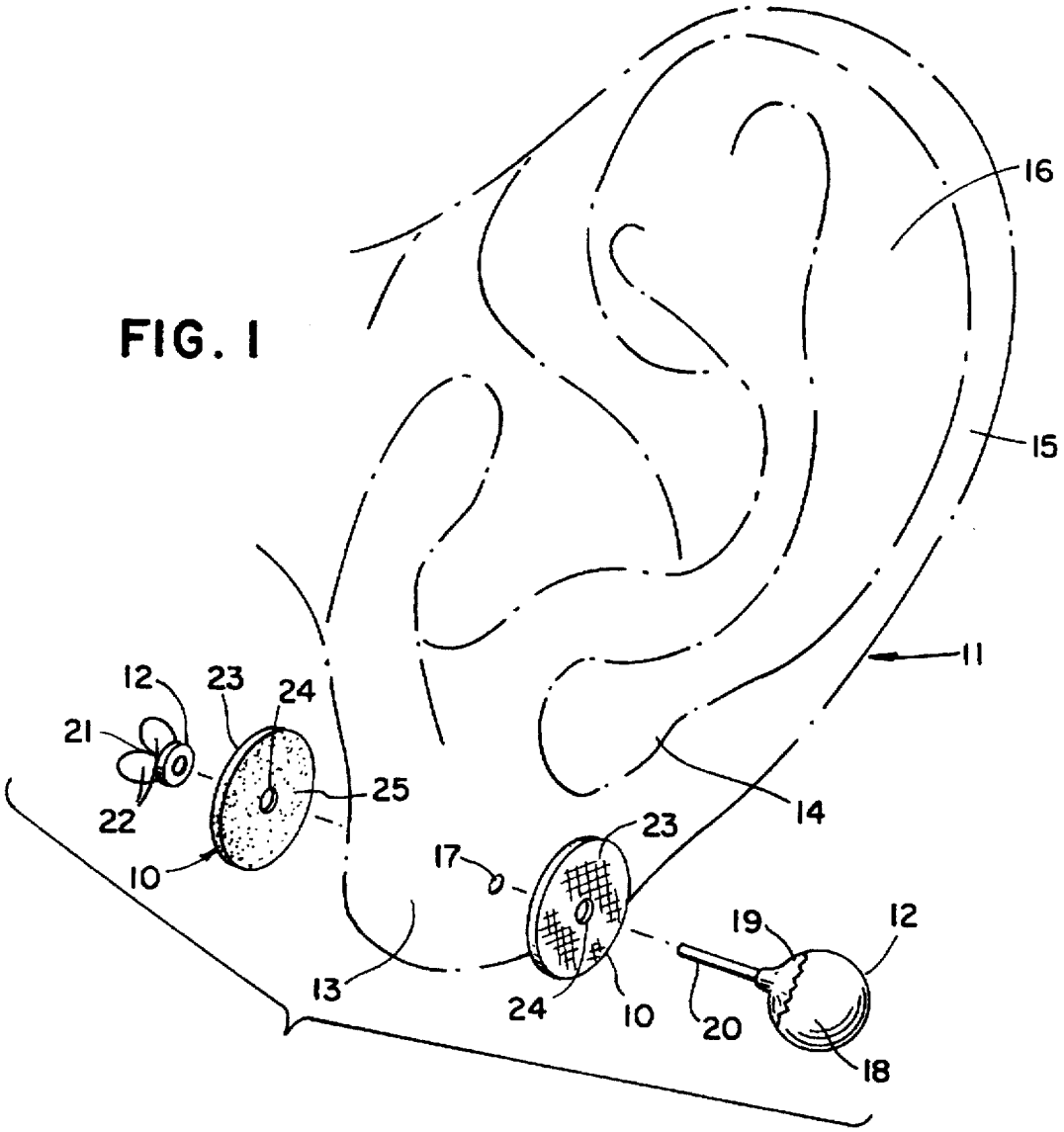
FIG. 1 is an illustration of a typical external human ear structure, shown in dotted outline, with my invention shown in expanded isometric view in relationship thereto.
Figure 2:
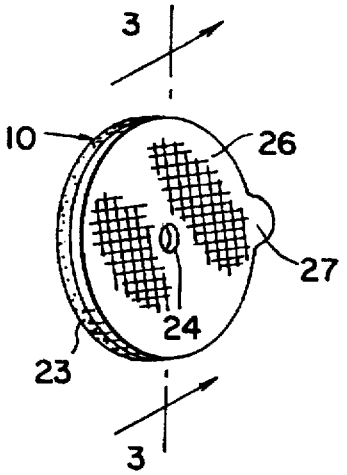
FIG. 2 is an isometric view of my ear patch showing its various elements, their configuration and relationship.
Figure 3:
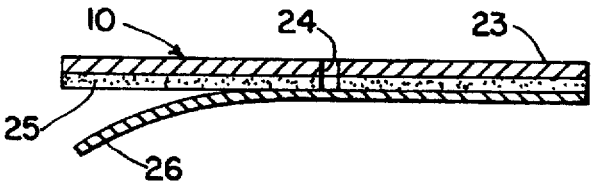
FIG. 3 is an enlarged cross-sectional view of the ear patch of FIG. 2, taken on the line 3—3 thereon in the direction indicated by the arrows.

My invention generally provides ear patch 10 for placement on human external ear structure 11 to aid in supporting earring 12 carried by that ear structure.

Ear structure 11 includes lobule 13, antitragus 14, helix 15, and helix fossa 16. Any of these portions of an ear structure may be pierced to define a hole therethrough to support earring 12. Most commonly in modern culture, the medial portion of the lobule 13 is pierced to define earring hole 17 to support a fastening post of an earring structure. The earring hole 17 extends between the opposed external surfaces of the lobule and commonly defines a relatively straight, somewhat cylindrical channel having a diameter approximating one millimeter (0.0487 inch) and a length usually approximating 0.25 inch (1.63 centimeters), depending upon the particular size and shape of an ear lobule in which the hole is defined. Since the tissue of the lobule is somewhat delicate in nature, earring hole 17 is commonly defined in a medial position in the lobule to provide an appropriate amount of tissue thereabout to maximize potential support for earring structures.

Earring 12, which is supported in a pierced ear, generally provides an ornamental portion 18 carried by fixing 19 which mechanically attaches ear fastening post 20 for insertion through earring hole 17 defined in a lobule. The fixing 19 is of such size that it will not pass through earring hole 17 and serves as a stop on one side of the ear structure, generally the outside, for ear fastening post 20. The post 20 is of such length as to extend through and beyond earring hole 17 when fixing 19 is adjacent one surface of the lobule defining bole 17, so that a portion of the fastening post projects on the side of the lobule opposite fixing 19. A separable ear post fastener 21 is releasably attachable to the end of the fastening post projecting through earring hole 17 on the side of the lobule opposite fixing 19. This ear post fastener 21 may have a variety of constructions, but most commonly it provides frictional elements (not shown) that engage upon ear fastening post 20 for positional maintenance of that post in the earring hole but are releasable by means of motion of spaced fastening ears 22 toward each other as accomplished by manual pinching manipulation by the fingers of a user, commonly the thumb and index fingers.

Other types of ear post fasteners accomplish positional maintenance by means of friction alone, by means of threaded engagement with the fastening post and by other similar means.

Another common method of maintaining fastening posts within an ear hole is to shape the fastening structure in a curvilinear fashion, such as in a "U" shape in the so-called fish-hook type fastener, so that the fastening structure may be inserted in an ear hole by reason of the resilient deformability of the tissue defining the hole, and after insertion be maintained therein by reason of the shape of the fastening structure as aided by gravity acting on an earring ornament supported thereby. My invention is usable with these various earring fastening structures, so long as the ear fastening structure defines an elongate element of size and shape that may be inserted in or through a hole defined in an ear structure, with the fastening structure extending from the ear hole, generally on both sides of the ear lobule.

My ear patch 10 for use with such an earring supported in an ear hole provides sheet-like flexible body 23, of some areal extent, defining medial ear fastening post hole 24. In the instance illustrated, the flexible body 23 is a sheet-like element of circular peripheral configuration and though the peripheral shape is not limited to this configuration, it is the preferred configuration. The size of the flexible body is necessarily limited by the size of the surface of an ear lobule or other ear structure to which the body is to be fastened. That size must be such as to provide adequate support for an ear fastening post to be supported thereby. Commonly with most resilient materials this requires an areal extent of approximately one-tenth square inch (1.65 square centimeters), and in the case of a circular disk would require a diameter of approximately 0.33 inches (0.84 centimeter). The diametrical size of hole 24 is preferably substantially the same as the diametrical size of an ear fastening post 20 to be supported, commonly somewhat less than one millimeter (0.0487 inch). The size of bole 24 is important to my invention as the effectiveness of support by my ear patch varies somewhat proportionately with the effectiveness of the fit of an ear fastening post in hole 24. Support is effective even if the hole 24 is larger than the ear post to be supported, but this effectiveness is not so great as if the sizes of the two elements are substantially the same.

Body 23 is preferably formed from woven fabric or sheet plastic material that is flexibly resilient and yet relatively strong and tenacious. The material from which common surgical adhesive tapes are formed is ideal, and fabric, plastic or plastic impregnated fabric types of such material are all operative with my invention. The thickness of the body material is preferably approximately 0.25 millimeter, though the thickness per se is not essential to my invention so long as the body material bas the appropriate physical characteristics specified. The body material must be resilient enough to conform to the surface contours of an ear structure and must also have sufficient strength and semi-rigidity to support a fastening post of an ear ornament extending therethrough. The material from which the patch is formed should be non-allergenic so as not cause reactions with the skin of a user, and preferably should be somewhat porous to allow air to reach the skin beneath the patch to aid in avoiding microbal growth and skin irritation. The non-allergenic forms of support materials used for common adhesive tapes available in the present day market place well fulfill these requirements as they have been designed to accomplish the same purposes.

One side of flexible body 23 is coated with a layer of adhesive material 25 to adhere the patch to the surface of an ear lobule about earring hole 17. This adhesive must be such as to adhere both to the body of the patch and to the surface of an ear lobule, and must also not damage the ear tissue. The adhesives commonly used in non-allergenic adhesive tapes fulfill this requirement as they have heretofore been specifically designed to accomplish the same purposes as required of the adhesive in my invention. The adhesive material preferably is established by known manufacturing means in a relatively thin uniform layer covering one entire surface of flexible patch 23.

The exposed adhesive surface is covered by sheet-like protective cover 26 of substantially the same peripheral configuration as resilient support 23. This protective cover keeps the adhesive surface free from debris and aids in maintaining the adhesive nature of the surface prior to use of the patch. The cover 26 commonly will be formed from a thin flexible sheet of coated paper or plastic material which adheres to the exposed surface of adhesive 25 sufficiently for positional maintenance, but yet is readily releasable by ordinary manual manipulation for removal. Tab 27 optionally may be provided on the periphery of the protective cover to project therebeyond to aid manual grasping of the cover for removal. This tab 27 is not necessary to my invention, and under some conditions may not be desirable, as it may tend to cause the accidental removal of the cover at undesired times.

Neither the size nor configuration of my ear patch are critical to my invention so long as the patch is not larger than an ear structure on which it is to be used and so long as it is large enough to provide support for an ear post of an ear ornament to be supported thereby. Commonly for aesthetic reasons, the patch will be no larger than necessary so that it is not too obvious, and for similar reasons the patch material will be of some neutral inconspicuous color and of surface nature such as would simulate the natural tissue of an ear structure on which it is to be positioned. These requirements tend to dictate a preferential form of ear patch of circular configuration and size substantially as herein specified. By reason of ear patch attachment to the surface of an ear structure, extensive radial size is not required for ear post support, as the support provided by a patch is provided within a short distance from the periphery of hole 24.

Having thusly described the structure of my ear patch, its use may be understood.

For use protective cover 26 is remove and the patch is established with its adhesive coated surface 25 adjacent the surface of an ear structure and its hole 24 immediately outwardly adjacent hole 17 defined in the ear structure. In this position, the ear patch is pressed against the adjacent surface of the ear structure to cause adhesion between the two adjacent surfaces, and the patch is then ready for use. A simple method to align the hole in the patch and that in an ear structure is to firstly insert fastening lost 20 of an earring in hole 24 of the ear patch, with ornament 18 on the inner side of the patch opposite from that carrying adhesive. The earring and patch are then both manually moved adjacent an ear structure on which they are to be established and the fastening post is inserted in earring hole 17 defined in that ear structure. This process automatically aligns hole 24 defined in the ear patch with hole 17 defined in the ear structure and the patch may then be moved into adjacency against the ear surface to cause adhesion on the ear while fastening post 20 is maintained within ear hole 17 to continuously maintain alignment of the holes. The skill or dexterity required to establish my patch is no greater than that required to establish an earring fastening post in a hole in an ear structure without the ear patch of my invention and the process can be readily accomplished without any particular skill or training by the habitually familiar manipulation of a person accustomed to wearing earrings.

Normally, one ear patch on one side of an ear structure is sufficient to support an earring in an earring hole, and commonly that patch will be placed on the external or lateral surface of the ear structure for ease of positioning and better support of a structure projecting laterally away from that surface. It is possible, however, that a single ear patch may be placed on the inner or medial surface of an ear structure, or that two patches may be used with one patch on both lateral and medial sides of the ear structure.

In placing a patch on the inner or medial surface of an ear structure, commonly ear post 20 will be inserted from the outer or lateral side of the ear structure into ear hole 17, with or without an intervening patch, and will be moved so that it extends medially inwardly from the earring hole. The inner or medial patch 10*a* will then be positioned over the medially projecting ear post by passing that post through hole 24 and the patch 10*a* then moved toward and adhered to the medial ear surface. This manipulation is little more difficult than the placement of an outer or lateral patch on the ear structure and may be quite as readily accomplished.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A two piece ear patch device in combination with an earring having an earring post comprising:

a first piece inner flexible patch having an adhesive coated surface and a hole through said inner patch; and, a second piece outer flexible patch having an adhesive coated surface and a hole through said outer patch, wherein said inner patch and said outer patch is positioned such that said earring post is adapted to extend through said inner patch hole and said outer patch hole.

2. The ear patch device of claim 1, further comprising a protective cover releasably attached to said inner patch adhesive surface and protective cover releasable attached to said outer patch adhesive surface.

3. The ear patch device of claim 1, said inner patch and said outer patch adhesive surface having medicants.

4. The ear patch device of claim 1, said ear patch made of plastic materials.

5. The ear patch device of claim 1, said inner and outer ear patch adhesive surface including medicants to discourage microbial activity and promote healing.

6. The ear patch device of claim 1, said inner patch having a flexible body layer made of fabric material.

7. A two piece ear patch device in combination with an earring having an earring post comprising:

a first piece inner patch having a flexible resilient body made of porous, non-allergenic material with a hole therethrough and coated on one surface with medicated adhesive;

a second piece outer patch having a flexible resilient body made of porous non-allergenic material with a hole therethrough and coated on one surface with medicated adhesive; and, wherein said post is adapted to extend through said inner patch hole and said outer patch hole.

8. The ear patch device of claim 7, further comprising a protective cover releasably attached to said inner patch adhesive and a protective cover releasably attached to said outer patch adhesive.

9. The ear patch device of claim 7, said inner patch body and said outer patch body made of plastic materials.

10. The ear patch device of claim 7, said inner patch having a flexible body layer made of fabric material.

* * * * *

UNITED STATES PATENT AND TRADEMARK OFFICE

CERTIFICATE OF CORRECTION

PATENT NO. : 5,638,701
DATED : June 17, 1997
INVENTOR(S) : Karen Searles

It is certified that error appears in the above-identified patent and that said Letters Patent is hereby corrected as shown below:

On the title page, item [76] Inventor: should read -- Karen Elaine Searles, P.O. Box 10327, Spokane, Wash., 992096 --.

Signed and Sealed this

Nineteenth Day of August, 1997

*Attest:*

*Attesting Officer*

BRUCE LEHMAN

*Commissioner of Patents and Trademarks*